US008690621B2

(12) United States Patent
Kuriyagawa et al.

(10) Patent No.: US 8,690,621 B2
(45) Date of Patent: Apr. 8, 2014

(54) OUTBOARD MOTOR CONTROL APPARATUS

(75) Inventors: Koji Kuriyagawa, Wako (JP); Hajime Yoshimura, Wako (JP); Hiroshi Yamamoto, Wako (JP); Nobuchika Katagiri, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 393 days.

(21) Appl. No.: 12/967,143

(22) Filed: Dec. 14, 2010

(65) Prior Publication Data

US 2011/0143609 A1 Jun. 16, 2011

(30) Foreign Application Priority Data

Dec. 16, 2009 (JP) ..... 2009-285800
Dec. 16, 2009 (JP) ..... 2009-285801
Dec. 16, 2009 (JP) ..... 2009-285806

(51) Int. Cl.
*B63H 20/14* (2006.01)

(52) U.S. Cl.
USPC ..... 440/86

(58) Field of Classification Search
USPC ..... 701/21, 51, 53–56; 440/1, 75, 86
See application file for complete search history.

(56) References Cited

U.S. PATENT DOCUMENTS 5,050,461 A 9/1991 Onoue et al.
5,230,643 A 7/1993 Kanno
5,711,742 A * 1/1998 Leinonen et al. ..... 477/121
6,200,177 B1 * 3/2001 Scott et al. ..... 440/75
6,238,255 B1 5/2001 Takase
6,350,165 B1 * 2/2002 Neisen ..... 440/75
6,695,657 B2 * 2/2004 Hattori ..... 440/84
7,762,859 B2 7/2010 Suzuki et al.
7,892,052 B2 2/2011 Suzuki et al.
8,105,199 B2 * 1/2012 Okabe ..... 475/318
8,162,708 B2 4/2012 Suzuki et al.
2004/0090195 A1 * 5/2004 Motsenbocker ..... 318/109
2009/0209151 A1 8/2009 Suzuki et al.
2009/0221193 A1 * 9/2009 Suzuki et al. ..... 440/1

FOREIGN PATENT DOCUMENTS

JP 4-159195 A 6/1992
JP 10-329586 A 12/1998
JP 2009-190671 A 8/2009
JP 2009-190673 A 8/2009
JP 2009-196515 A 9/2009
JP 2009-202686 A 9/2009

* cited by examiner

*Primary Examiner* — Edwin Swinehart
(74) *Attorney, Agent, or Firm* — Carrier Blackman & Associates, P.C.; Joseph P. Carrier; Anne G. Sabourin

(57) ABSTRACT

In an apparatus for controlling operation of an outboard motor having an internal combustion engine to power a propeller, and a transmission being selectively changeable in gear position to establish speeds including a first speed and a second speed and transmitting power of the engine to the propeller with a gear ratio determined by established speed, engine speed is detected, it is determined whether acceleration is instructed when the second speed is established, and operation of the transmission is controlled to change the gear position from the second speed to the first speed when the acceleration is determined to be instructed, and then change back the gear position from the first speed to the second speed based on the detected engine speed, thereby enabling to control the transmission optimally.

21 Claims, 11 Drawing Sheets

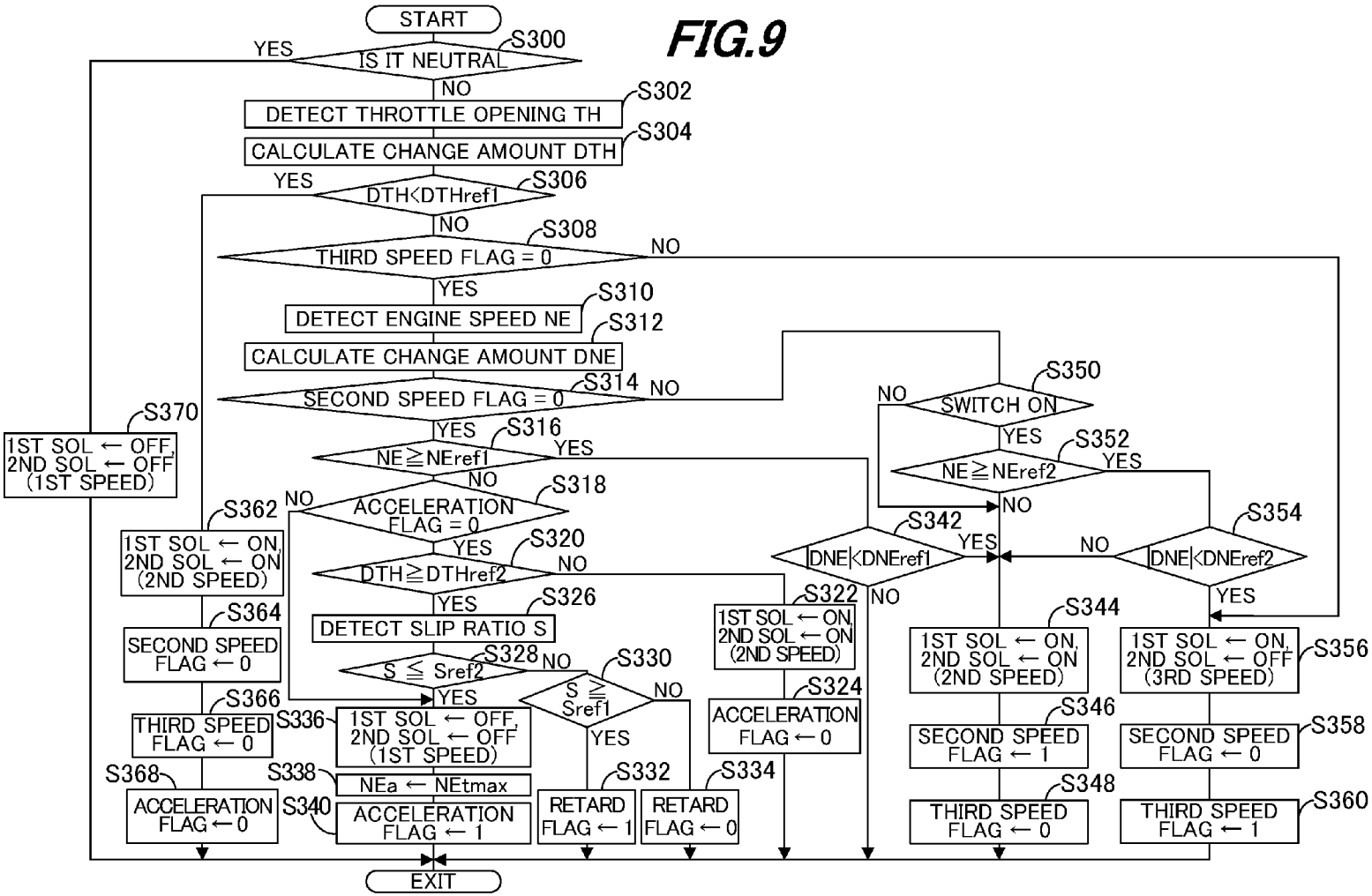
FIG.9
START
S300
IS IT NEUTRAL
YES
NO
S302
DETECT THROTTLE OPENING TH
S304
CALCULATE CHANGE AMOUNT DTH
S306
DTH<DTHref1
YES
NO
S308
THIRD SPEED FLAG = 0
YES
NO
S310
DETECT ENGINE SPEED NE
S312
CALCULATE CHANGE AMOUNT DNE
S314
SECOND SPEED FLAG = 0
YES
NO
S316
NE≧NEref1
YES
NO
S318
ACCELERATION FLAG = 0
YES
NO
S320
DTH≧DTHref2
YES
NO
S326
DETECT SLIP RATIO S
S328
S ≦ Sref2
YES
NO
S330
S ≧ Sref1
YES
NO
S332
RETARD FLAG ← 1
S334
RETARD FLAG ← 0
S336
1ST SOL ← OFF, 2ND SOL ← OFF (1ST SPEED)
S338
NEa ← NEtmax
S340
ACCELERATION FLAG ← 1
S342
DNE<DNEref1
YES
NO
S344
1ST SOL ← ON, 2ND SOL ← ON (2ND SPEED)
S346
SECOND SPEED FLAG ← 1
S348
THIRD SPEED FLAG ← 0
S350
SWITCH ON
YES
NO
S352
NE≧NEref2
YES
NO
S354
DNE<DNEref2
YES
NO
S356
1ST SOL ← ON, 2ND SOL ← OFF (3RD SPEED)
S358
SECOND SPEED FLAG ← 0
S360
THIRD SPEED FLAG ← 1
S362
1ST SOL ← ON, 2ND SOL ← ON (2ND SPEED)
S364
SECOND SPEED FLAG ← 0
S366
THIRD SPEED FLAG ← 0
S368
ACCELERATION FLAG ← 0
S370
1ST SOL ← OFF, 2ND SOL ← OFF (1ST SPEED)
S322
1ST SOL ← ON, 2ND SOL ← ON (2ND SPEED)
S324
ACCELERATION FLAG ← 0
EXIT

OUTBOARD MOTOR CONTROL APPARATUS

BACKGROUND OF THE INVENTION

1. Field of the Invention

This invention relates to an outboard motor control apparatus, particularly to an apparatus for controlling an outboard motor with a transmission.

2. Description of the Related Art

In recent years, there is proposed an outboard motor having a transmission interposed at a location between an internal combustion engine and a propeller shaft to change output of the engine in speed and transmit it to a propeller, as taught, for example, by Japanese Laid-Open Patent Application No. 2009-190671. In the reference, the operation of the transmission is controlled based on a lever opening (position) of a throttle lever and speed of the engine.

SUMMARY OF THE INVENTION

However, in the configuration of the above reference, since the transmission control is performed based on the lever opening of the throttle lever manipulated by the operator and the like, it does not necessarily lead to the optimal gear position which reflects the cruising condition of the boat mounted with the outboard motor, i.e., the operating condition of the engine installed in the outboard motor.

An object of this invention is therefore to overcome the foregoing drawbacks by providing an apparatus for controlling an outboard motor having a transmission, which apparatus can conduct the optimal transmission control of the transmission based on the operating condition of the engine.

In order to achieve the object, this invention provides in a first aspect an apparatus for controlling operation of an outboard motor adapted to be mounted on a stern of a boat and having an internal combustion engine to power a propeller through a propeller shaft, and a transmission installed at a location between the engine and the propeller shaft, the transmission being selectively changeable in gear position to establish speeds including at least a first speed and a second speed and transmitting power of the engine to the propeller with a gear ratio determined by established speed, comprising: an engine speed detector that detects speed of the engine; an acceleration instruction determiner that determines whether acceleration is instructed to the engine when the second speed is established; and a transmission controller that controls operation of the transmission to change the gear position from the second speed to the first speed when the acceleration is determined to be instructed, and then change back the gear position from the first speed to the second speed based on the detected engine speed.

In order to achieve the object, this invention provides in a second aspect a method for controlling operation of an outboard motor adapted to be mounted on a stern of a boat and having an internal combustion engine to power a propeller through a propeller shaft, and a transmission installed at a location between the engine and the propeller shaft, the transmission being selectively changeable in gear position to establish speeds including at least a first speed and a second speed and transmitting power of the engine to the propeller with a gear ratio determined by established speed, comprising the steps of: detecting speed of the engine; determining whether acceleration is instructed to the engine when the second speed is established; and controlling operation of the transmission to change the gear position from the second speed to the first speed when the acceleration is determined to be instructed, and then change back the gear position from the first speed to the second speed based on the detected engine speed.

BRIEF DESCRIPTION OF THE DRAWINGS

The above and other objects and advantages of the invention will be more apparent from the following description and drawings in which:

FIG. 9 is a flowchart similar to FIG. 6, but showing transmission control operation, etc., by an electronic control unit of an outboard motor control apparatus according to a second embodiment of the invention;

DETAILED DESCRIPTION OF THE PREFERRED EMBODIMENTS

Preferred embodiments of an outboard motor control apparatus according to the invention will now be explained with reference to the attached drawings.

Figure 1:
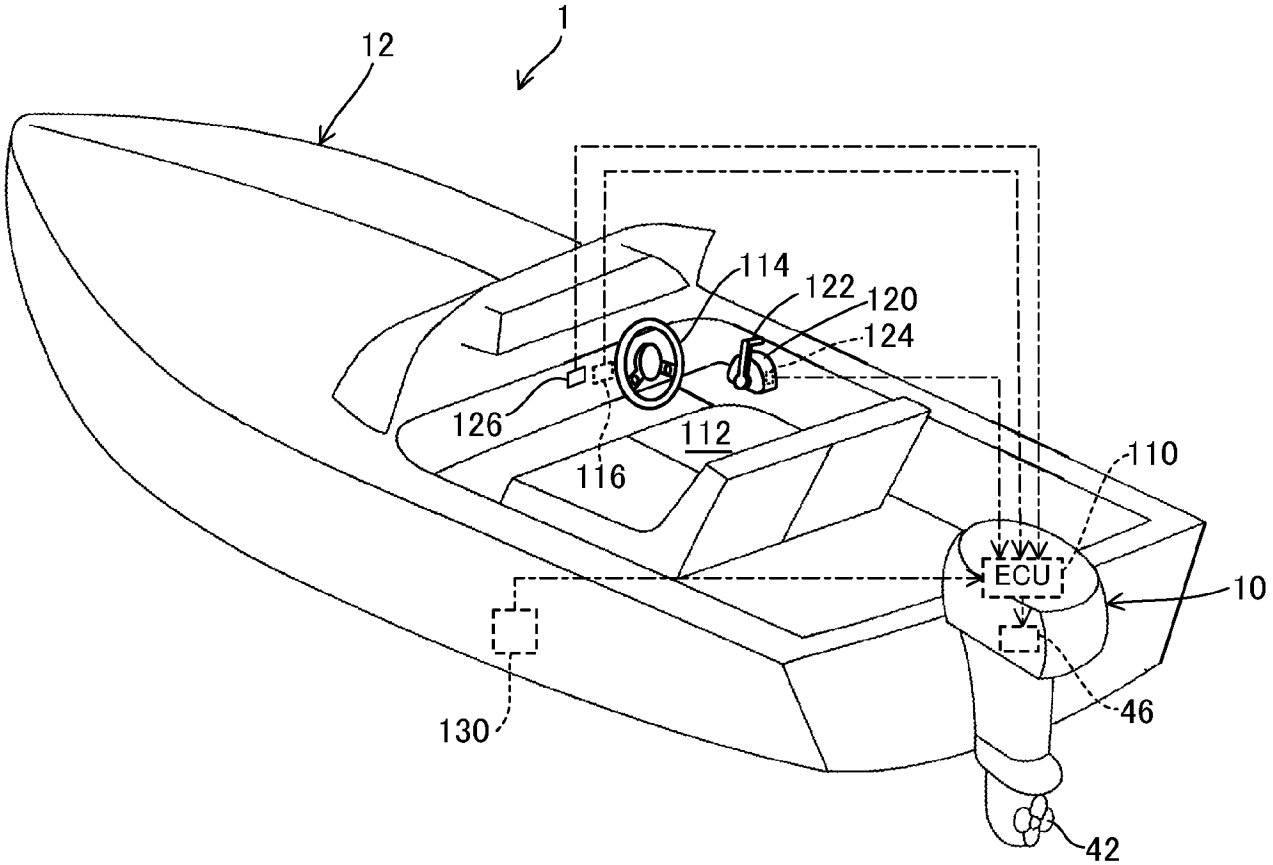
FIG. 1 is an overall schematic view of an outboard motor control apparatus including a boat according to a first embodiment of the invention.
Figure 2:
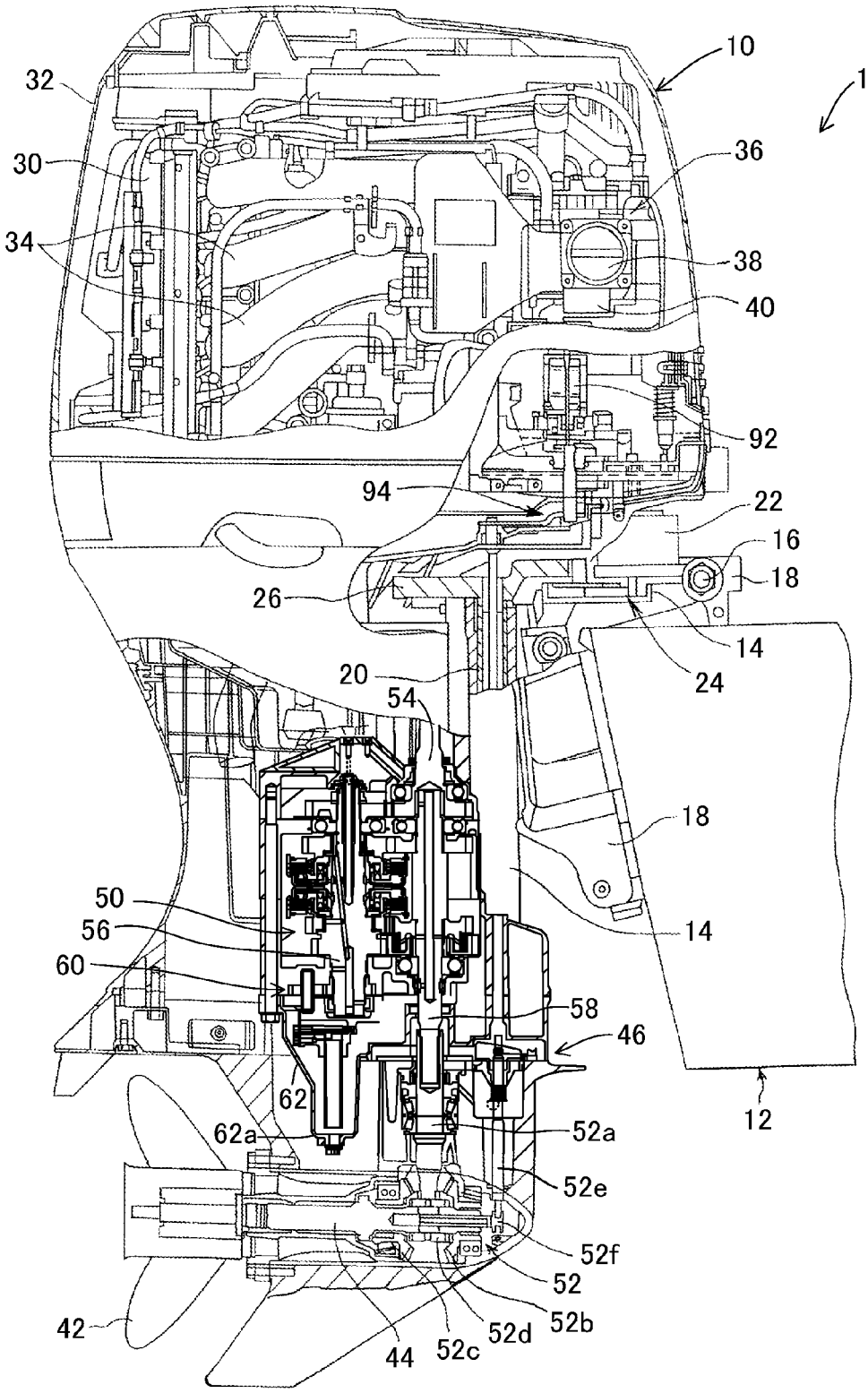
FIG. 2 is an enlarged sectional side view partially showing the outboard motor shown in FIG. 1.

FIG. 1 is an overall schematic view of an outboard motor control apparatus including a boat according to a first embodiment of the invention. FIG. 2 is an enlarged sectional side view partially showing the outboard motor shown in FIG. 1 and FIG. 3 is an enlarged side view of the outboard motor.

Figure 3:
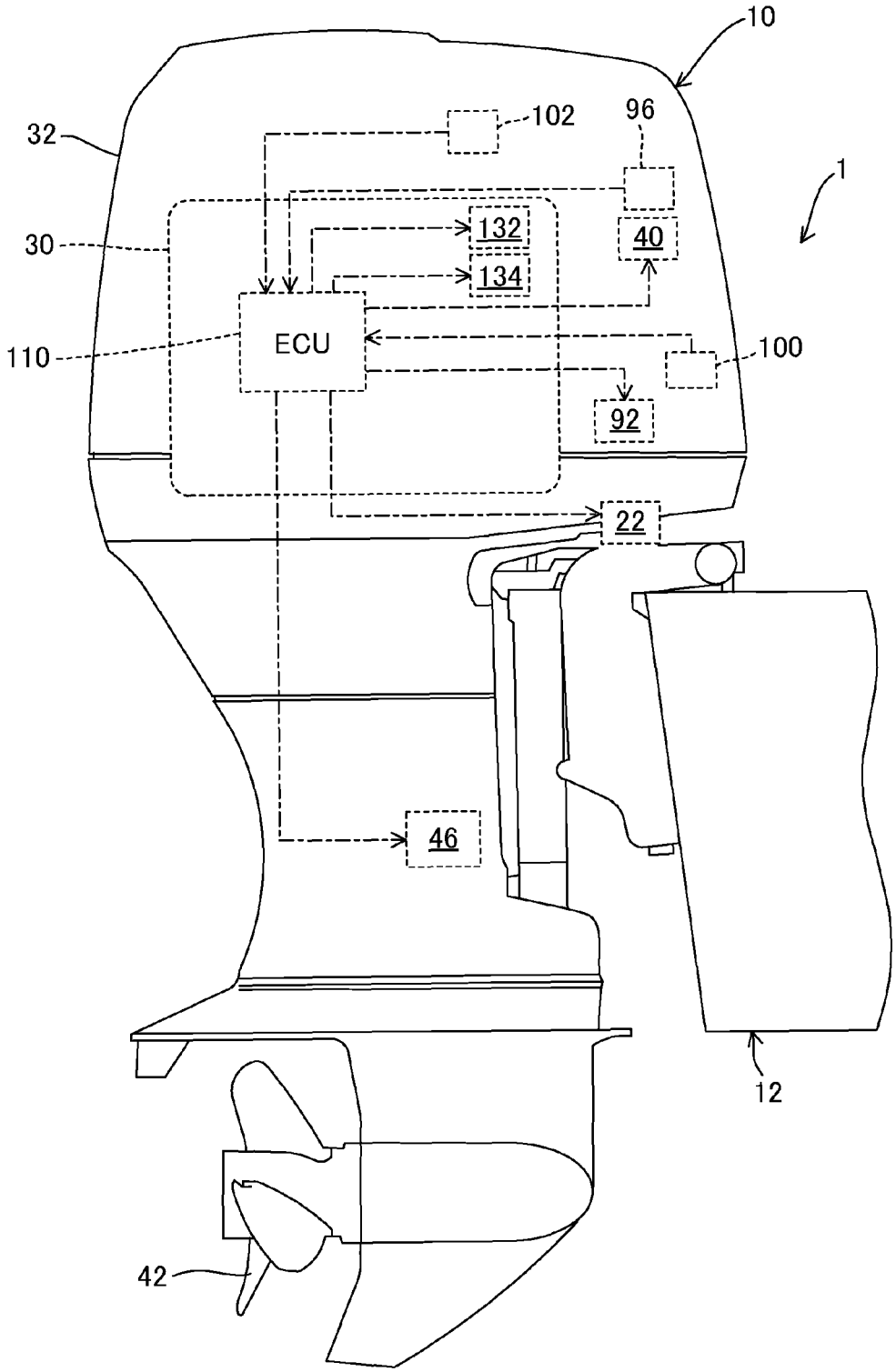
FIG. 3 is an enlarged side view of the outboard motor shown in FIG. 1.

In FIGS. 1 to 3, a symbol 1 indicates a boat or vessel whose hull 12 is mounted with an outboard motor 10. As clearly shown in FIG. 2, the outboard motor 10 is clamped (fastened) to the stern or transom of the boat 1, more precisely, to the stern of the hull 12 through a swivel case 14, tilting shaft 16 and stern brackets 18.

An electric steering motor (actuator) 22 for operating a shaft 20 which is housed in the swivel case 14 to be rotatable about the vertical axis is installed above the swivel case 14. A rotational output of the steering motor 22 is transmitted to the shaft 20 via a speed reduction gear mechanism 24 and a mount frame 26, whereby the outboard motor 10 is steered about the shaft 20 as a steering axis to the right and left directions (steered about the vertical axis).

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control engine speed NE of the engine 30.

The outboard motor 10 further comprises a propeller shaft (power transmission shaft) 44 that is supported to be rotatable about the horizontal axis and attached with a propeller 42 at its one end to transmit power output of the engine 30 thereto, and a transmission (automatic transmission) 46 that is interposed at a location between the engine 30 and propeller shaft 44 and has a plurality of gear positions, i.e., first, second and third speeds.

The transmission 46 comprises a transmission mechanism 50 that is selectively changeable in gear positions to establish speeds including the first to third speeds, and a shift mechanism 52 that can change a shift position among forward, reverse and neutral positions. The transmission 50 has the three speeds in the forward position.

Figure 4:
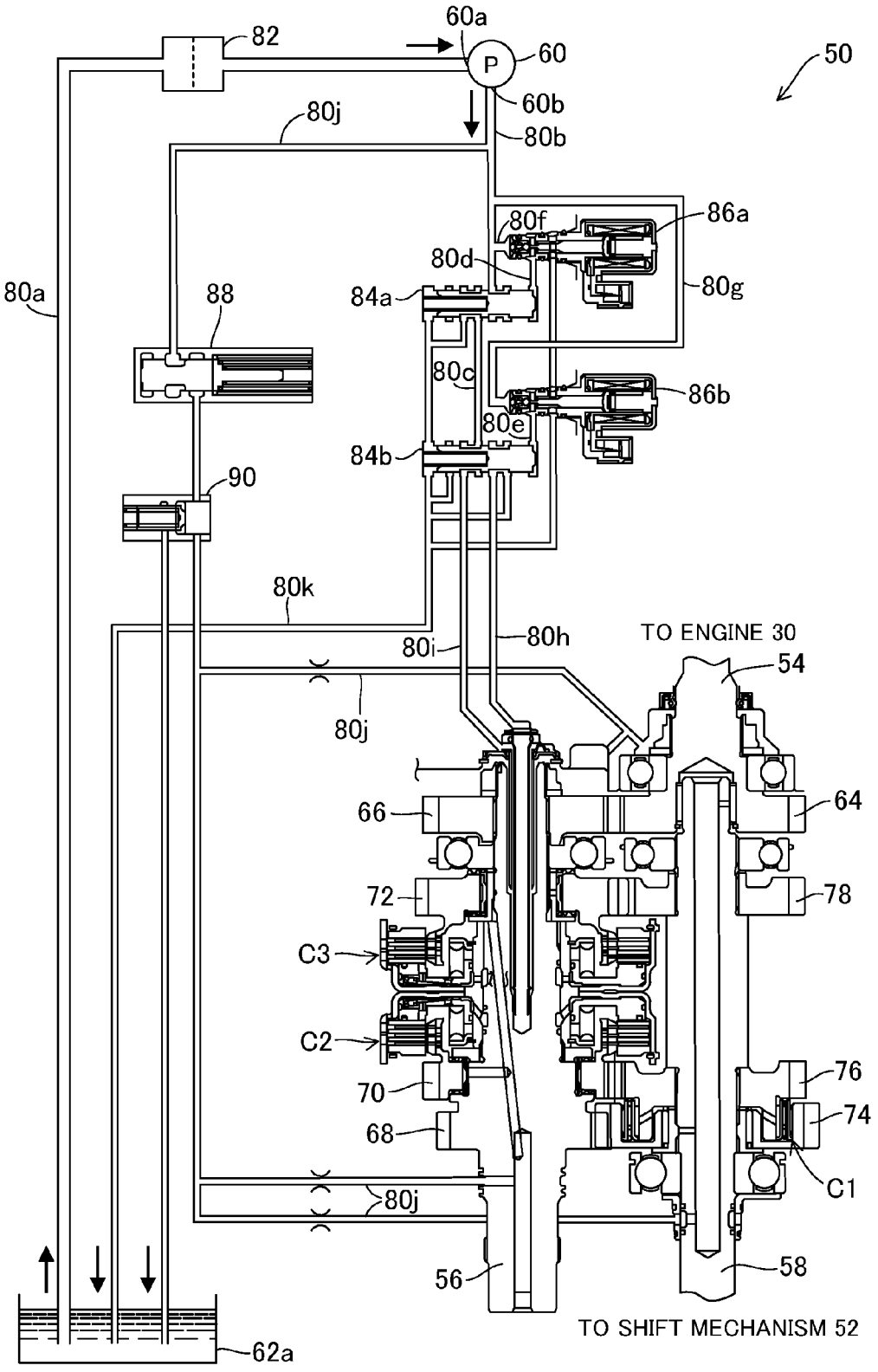
FIG. 4 is a hydraulic circuit diagram schematically showing a hydraulic circuit of a transmission mechanism shown in FIG. 2.

FIG. 4 is a hydraulic circuit diagram schematically showing a hydraulic circuit of the transmission mechanism 50.

As shown in FIGS. 2 and 4, the transmission mechanism 50 comprises a parallel-axis type transmission mechanism with distinct gear positions (ratios), which includes an input shaft 54 connected to the crankshaft (not shown in the figures) of the engine 30, a countershaft 56 connected to the input shaft 54 through a gear, and an output shaft 58 connected to the countershaft 56 through several gears. Those shafts 54, 56, 58 are installed in parallel.

The countershaft 56 is connected with a hydraulic pump (gear pump;

shown in FIGS. 2 and 4) 60 that pumps up the operating oil (lubricating oil) and forwards it to transmission clutches and lubricated portions of the transmission mechanism 50 (explained later). The foregoing shafts 54, 56, 58, hydraulic pump 60 and the like are housed in a case 62 (shown only in FIG. 2). An oil pan 62*a* for receiving the operating oil is formed at the bottom of the case 62.

In the so-configured transmission mechanism 50, the gear installed on the shaft to be rotatable relative thereto is fixed on the shaft through the transmission clutch so that the transmission 46 is selectively changeable in the gear position to establish the three speeds (i.e., first to third speeds), and the output of the engine 30 is changed with the gear ratio determined by the established (selected) gear position (speed; gear) and transmitted to the propeller 42 through the shift mechanism 52 and propeller shaft 44.

A gear ratio (speed reduction ratio) of the gear position (speed) is set to be the highest in the first speed and decreases as the speed changes to second and then third speed. Specifically, for instance, the first speed gear ratio is 2.2, the second speed gear ratio 2.0, and the third speed gear ratio 1.7.

The further explanation on the transmission mechanism 50 will be made. As clearly shown in FIG. 4, the input shaft 54 is supported with an input primary gear 64. The countershaft 56 is supported with a counter primary gear 66 to be meshed with the input primary gear 64, and also with a counter first-speed gear 68, counter second-speed gear 70 and counter third-speed gear 72.

The output shaft 58 is supported with an output first-speed gear 74 to be meshed with the counter first-speed gear 68, an output second-speed gear 76 to be meshed with the counter second-speed gear 70, and an output third-speed gear 78 to be meshed with the counter third-speed gear 72.

In the above configuration, when the output first-speed gear 74 supported to be rotatable relative to the output shaft 58 is brought into a connection with the output shaft 58 through a first-speed clutch C1, the first speed (gear position) is established. The first-speed clutch C1 comprises a one-way clutch. When a second-speed or third-speed hydraulic clutch C2 or C3 (explained later) is supplied with hydraulic pressure so that the second or third speed (gear postion) is established and the rotational speed of the output shaft 58 becomes greater than that of the output first-speed gear 74, the first-speed clutch C1 makes the output first-speed gear 74 rotate idly (i.e., rotate without being meshed).

When the counter second-speed gear 70 supported to be rotatable relative to the countershaft 56 is brought into a connection with the countershaft 56 through the second-speed hydraulic clutch (transmission clutch) C2, the second speed (gear position) is established. Further, when the counter third-speed gear 72 supported to be rotatable relative to the countershaft 56 is brought into a connection with the countershaft 56 through the third-speed hydraulic clutch (transmission clutch) C3, the third speed (gear position) is established. The hydraulic clutches C2, C3 connect the gears 70, 72 to the countershaft 56 upon being supplied with the operating oil, while making the gears 70, 72 rotate idly when the operating oil is not supplied.

The interconnections between the gears and shafts through the clutches C1, C2, C3 are performed by controlling hydraulic pressure supplied from the pump 60 to the hydraulic clutches C2, C3.

The further explanation will be made with reference to FIG. 4. An intake port 60*a* of the pump 60 is connected to the oil pan 62*a* through an oil passage 80*a*. The oil passage 80*a* is interposed with a strainer 82.

A discharge port 60*b* of the pump 60 is connected to a first switching valve 84*a* through an oil passage 80*b* and the first switching valve 84*a* is connected to a second switching valve 84*b* through an oil passage 80*c*. Each of the valves 84*a*, 84*b* has a movable spool installed therein. The spool is urged by a spring at its one end (left end in the drawing) toward the other end.

The first and second switching valves 84*a*, 84*b* are connected on the sides of the other ends of the spools with first and second electromagnetic solenoid valves (linear solenoid valves) 86*a*, 86*b* through oil passages 80*d*, 80*e*, respectively. The solenoid valves 86*a*, 86*b* are interposed at oil passages 80*f*, 80*g* which are branched from the oil passage 80*b*.

The second switching valve 84*b* is connected to the second-speed hydraulic clutch C2 through an oil passage 80*h*, while being connected to the third-speed hydraulic clutch C3 through an oil passage 80*i*.

The discharge port 60*b* is also connected to the lubricated portions (e.g., the shafts 54, 56, 58, etc.) of the transmission 46 through the oil passage 80*b* and an oil passage 80*j* branched therefrom. The oil passage 80*j* is interposed with a regulator valve 88 that regulates hydraulic pressure to be supplied to the lubricated portions, and a relief valve 90 that, when the hydraulic pressure of the operating oil regulated by the regulator valve 88 becomes equal to or greater than prescribed pressure, returns the operating oil to the oil pan 62*a*.

The first and second switching valves 84*a*, 84*b* and the first and second solenoid valves 86*a*, 86*b* are connected with an oil passage 80*k* adapted to relieve pressure and an end of the oil passage 80*k* is open at the oil pan 62*a*.

As configured above, the pump 60 driven by the engine 30 (more exactly, the countershaft 56 of the transmission 46 transmitted with the output of the engine 30) pumps up the operating oil in the oil pan 62*a* through the oil passage 80*a* and strainer 82 and forwards it from the discharge port 60*b* to the first switching valve 84*a* and the first and second solenoid valves 86*a*, 86*b* through the oil passage 80*b* and the like. The pump 60 also supplies the operating oil (lubricating oil) to the lubricated portions of the transmission 46 through the oil passage 80*j*, regulator valve 88 and relief valve 90.

Upon being supplied with current (i.e., made ON), a spool housed in the first solenoid valve 86*a* is displaced to output the hydraulic pressure supplied from the pump 60 to the other end side of the spool of the first switching valve 84*a*. The spool of the first switching valve 84*a* is displaced in response to the hydraulic pressure outputted to its other end side, thereby forwarding the operating oil in the oil passage 80*b* to the oil passage 80*c*.

Similarly to the first solenoid valve 86*a*, upon being supplied with current (i.e., made ON), a spool of the second solenoid valve 86*b* is displaced to output the hydraulic pressure supplied from the pump 60 to the other end side of the spool of the second switching valve 84*b*.

When the second solenoid valve 86*b* is made ON and the hydraulic pressure is outputted to the other end side of the spool of the second switching valve 84*b* so that the spool is displaced, the operating oil in the oil passage 80*c* is forwarded to the second-speed hydraulic clutch C2 through the oil passage 80*h*. In contrast, when the second solenoid valve 86*b* is not supplied with current (made OFF) and the hydraulic pressure is not outputted to the other end side, the second switching valve 84*b* forwards the operating oil in the oil passage 80*c* to the third-speed hydraulic clutch C3 through the oil passage 80*i*.

Consequently, when the first and second solenoid valves 86*a*, 86*b* are both made OFF, the hydraulic pressure is not supplied to the hydraulic clutches C2, C3 and hence, the output first-speed gear 74 and output shaft 58 are interconnected through the first-speed clutch C1 so that the first speed is established.

When the first and second solenoid valves 86*a*, 86*b* are both made ON, the hydraulic pressure is supplied to the second-speed hydraulic clutch C2 and accordingly, the counter second-speed gear 70 and countershaft 56 are interconnected so that the second speed is established. As mentioned in the foregoing, when the second speed is established and the rotational speed of the output shaft 58 exceeds that of the output first-speed gear 74, the gear 74 is disconnected from the shaft 58 by the first-speed clutch C1 and therefore rotated idly.

Further, when the first solenoid valve 86*a* is made ON and the second solenoid valve 86*b* is made OFF, the hydraulic pressure is supplied to the third-speed hydraulic clutch C3 and accordingly, the counter third-speed gear 72 and countershaft 56 are interconnected so that the third speed is established. As in the case of the second speed, the output first-speed gear 74 is rotated idly. Thus, the second-speed and third-speed hydraulic clutches C2, C3 are the transmission clutches that can establish the gear positions of first to third speeds, and one of the gear positions of the transmission 46 is selected (i.e., transmission control is conducted) by controlling ON/OFF of the first and second switching valves 84*a*, 84*b*.

The explanation on FIG. 2 is resumed. The shift mechanism 52 comprises a drive shaft (vertical shaft) 52*a* that is connected to the output shaft 58 of the transmission mechanism 50 and installed parallel to the vertical axis to be rotatably supported, a forward bevel gear 52*b* and reverse bevel gear 52*c* that are connected to the drive shaft 52*a* to be rotated, a clutch 52*d* that can engage the propeller shaft 44 with either one of the forward bevel gear 52*b* and reverse bevel gear 52*c*, and other components.

The interior of the engine cover 32 is disposed with an electric shift motor (actuator) 92 that drives the shift mechanism 52. The output shaft of the shift motor 92 can be connected via a speed reduction gear mechanism 94 with the upper end of a shift rod 52*e* of the shift mechanism 52. When the shift motor 92 is operated, its output appropriately displaces the shift rod 52*e* and a shift slider 52*f* to move the clutch 52*d* to change the shift position among the forward, reverse and neutral positions.

When the shift position is forward or reverse, the rotational output of the output shaft 58 is transmitted via the shift mechanism 52 to the propeller shaft 44 to rotate the propeller 42 in one of the directions making the boat 1 move forward or rearward. The outboard motor 10 is equipped with a power source (not shown) such as a battery or the like attached to the engine 30 to supply operating power to the motors 22, 40, 92, etc.

As shown in FIG. 3, a throttle opening sensor (throttle opening change amount detector) 96 is installed near the throttle valve 38 and produces an output or signal indicative of opening of the throttle valve 38, i.e., throttle opening TH.

A neutral switch (neutral position determiner) 100 is installed near the shift rod 52*e* and produces an ON signal when the shift position of the transmission 46 is neutral and an OFF signal when it is forward or reverse. A crank angle sensor (engine speed detector) 102 is installed near the crankshaft of the engine 30 and produces a pulse signal at every predetermined crank angle.

The outputs of the foregoing sensors and switch are sent to an Electronic Control Unit (ECU) 110 disposed in the outboard motor 10. The ECU 110 which has a microcomputer comprising a CPU, ROM, RAM and other devices is installed in the engine cover 32 of the outboard motor 10.

As shown in FIG. 1, a steering wheel 114 is installed near a cockpit (the operator's seat) 112 of the hull 12 to be manipulated or rotated by the operator (not shown). A steering angle sensor 116 attached on a shaft (not shown) of the steering wheel 114 produces an output or signal corresponding to the steering angle applied or inputted by the operator through the steering wheel 114.

A remote control box 120 provided near the cockpit 112 is equipped with a shift/throttle lever (throttle lever) 122 installed to be manipulated by the operator. The lever 122 can be moved or swung in the front-back direction from the initial position and is used by the operator to input a forward/reverse change command and an engine speed regulation command including an acceleration/deceleration command or instruction (i.e., a desired engine speed NEa of the engine 30). A lever position sensor 124 is installed in the remote control box 120 and produces an output or signal corresponding to a position of the lever 122.

A switch 126 is also provided near the cockpit 112 to be manually operated by the operator to input a fuel consumption decreasing command for decreasing fuel consumption of the engine 30. The switch 126 is manipulated or pressed when the operator desires to travel the boat 1 with high fuel efficiency, and upon the manipulation, it produces a signal (ON signal) indicative of the fuel consumption decreasing command.

A boat speed sensor (speedometer for water) 130 is installed at an appropriate position of the hull 12 and produces an output or signal corresponding to speed or velocity (boat speed; hereinafter sometimes called the "actual velocity") V of the boat 1. The outputs of the sensors 116, 124, 130 and switch 126 are also sent to the ECU 110.

Based on the inputted outputs, the ECU 110 controls the operation of the motors 22, 92 and performs the transmission control of the transmission 46. The ECU 110 also counts the output pulses inputted from the crank angle sensor 102 to detect or calculate the engine speed NE and, based on the detected engine speed NE and throttle opening TH, controls the operation of the throttle motor 40 so that the engine speed NE converges on the desired engine speed NEa (which is set in accordance with a position of the lever 122).

Further, based on the inputted outputs, the ECU 110 determines a fuel injection amount and ignition timing of the engine 30 to supply fuel by the determined injection amount from an injector 132 (shown in FIG. 3) and ignite air-fuel mixture, which is composed of injected fuel and sucked air, at the determined ignition timing through an injection device 134.

Thus, the outboard motor control apparatus according to the embodiments is a Drive-By-Wire type apparatus whose operation system (steering wheel 114, lever 122) has no mechanical connection with the outboard motor 10.

Figure 5:
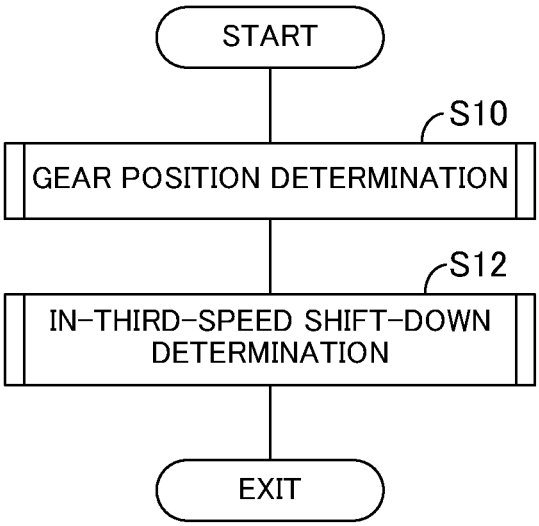
FIG. 5 is a flowchart showing transmission control operation by an electronic control unit shown in FIG. 1.

FIG. 5 is a flowchart showing the transmission control operation by the ECU 110. The illustrated program is executed by the ECU 110 at predetermined intervals, e.g., 100 milliseconds.

The program begins at S10, in which the operation for determining which gear position of the transmission 46 from among the first to third speeds is to be selected, is conducted.

Figure 6:
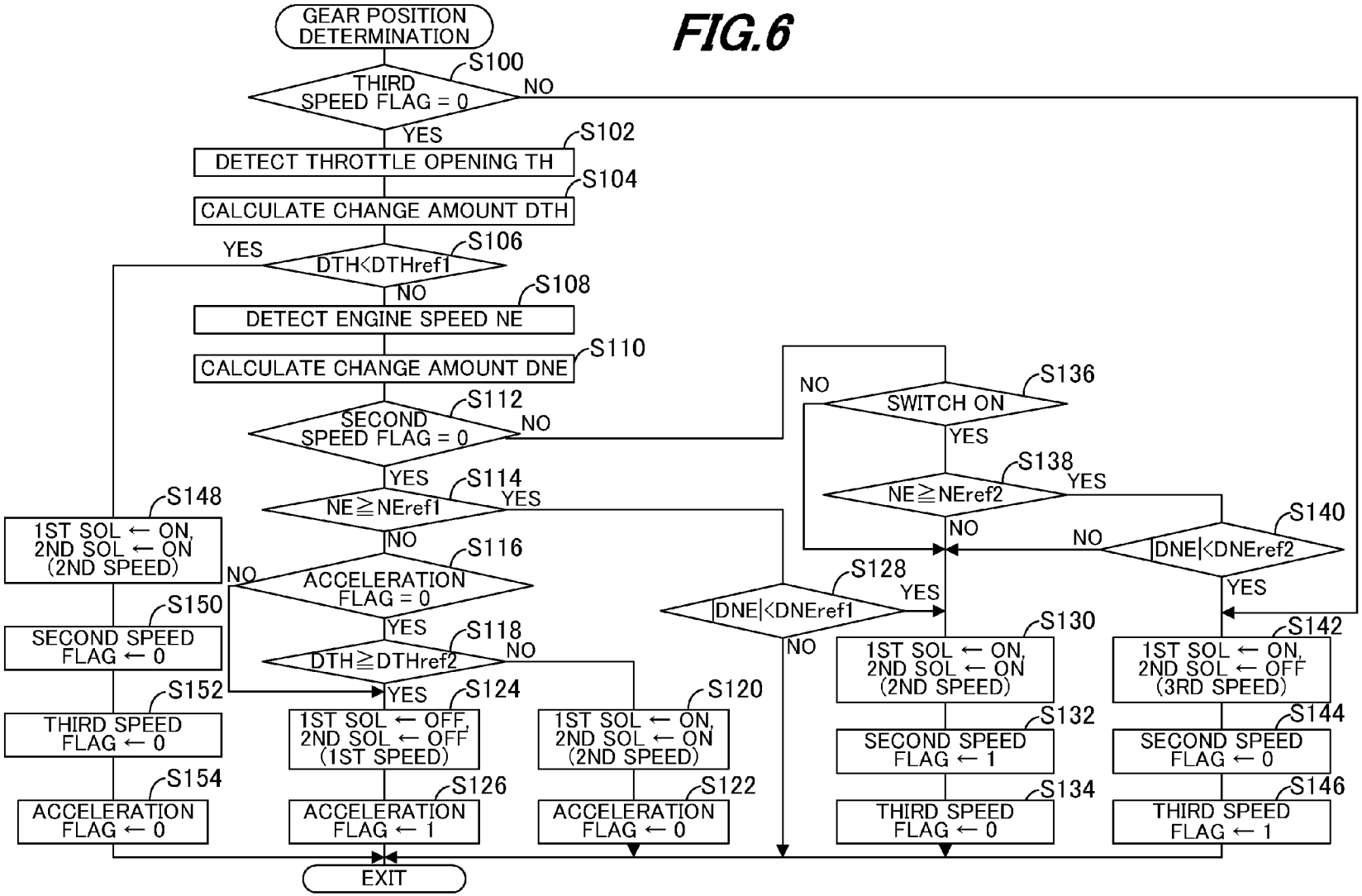
FIG. 6 is a subroutine flowchart showing the operation of gear position determination of the FIG. 5 flowchart.

FIG. 6 is a subroutine flowchart showing the operation of gear position determination. The explanation will be made with reference to FIG. 6.

In S100, it is determined whether the bit of an after-acceleration third-speed changed flag (explained later; hereinafter called the "third speed flag") which indicates that the gear position has been changed to the third speed after the acceleration was completed, is 0. Since the initial value of this flag is 0, the result in S100 in the first program loop is generally affirmative and the program proceeds to S102, in which the throttle opening TH is detected or calculated from the output of the throttle opening sensor 96, and to S104, in which a change amount (variation) DTH of the detected throttle opening TH per unit time (e.g., 500 milliseconds) is detected or calculated.

The program proceeds to S106, in which it is determined whether the deceleration is instructed to the engine 30 by the operator, i.e., whether the engine 30 is in the operating condition to decelerate the boat 1. This determination is made by checking as to whether the throttle valve 38 is operated in the closing direction, i.e., whether the change amount DTH is less than a first predetermined value DTHref1 (e.g., −0.5 degree).

Specifically, when the change amount DTH is less than the first predetermined value DTHref1 set to a negative value, the throttle valve 38 is determined to be operated in the closing direction (i.e., the deceleration is instructed to the engine 30) and when the change amount DTH is equal to or greater than the first predetermined value DTHref1, the throttle valve 38 is determined to be substantially stopped or operated in the opening direction (i.e., the deceleration is not instructed).

When the result in S106 is negative, the program proceeds to S108, in which the engine speed NE is detected or calculated from the output of the crank angle sensor 102, and to S110, in which a change amount (variation) DNE of the engine speed NE is detected or calculated. The change amount DNE is obtained by subtracting the engine speed NE detected in the present program loop from that detected in the previous program loop.

Next, the program proceeds to S112, in which it is determined whether the bit of an after-acceleration second-speed changed flag (hereinafter called the "second speed flag") is 0. The bit of this flag is set to 1 when the gear position is changed from the first speed to the second speed after the acceleration is completed, and otherwise, reset to 0.

Since the initial value of the second speed flag is also 0, the result in S112 in the first program loop is generally affirmative and the program proceeds to S114, in which it is determined whether the engine speed NE is equal to or greater than a first predetermined speed NEref1. The first predetermined speed NEref1 will be explained later.

Since the engine speed NE is less than the first predetermined speed NEref1 generally in a program loop immediately after the engine start, the result in S114 is negative and the program proceeds to S116, in which it is determined whether the bit of an acceleration determining flag (explained later; indicated by "acceleration flag" in the drawing) is 0. Since the initial value of this flag is also 0, the result in S116 in the first program loop is generally affirmative and the program proceeds to S118.

In S118, it is determined whether the acceleration (precisely, the rapid acceleration) is instructed to the engine 30 by the operator, i.e., whether the engine 30 is in the operating condition to accelerate the boat 1 (rapidly). This determination is made by checking as to whether the throttle valve 38 is operated in the opening direction rapidly.

Specifically, the change amount DTH of the throttle opening TH detected in S104 is compared with a second predetermined value DTHref2 and when the change amount DTH is equal to or greater than the second predetermined value DTHref2, it is determined that the throttle valve 38 is operated in the opening direction rapidly, i.e., the acceleration is instructed to the engine 30. The second predetermined value DTHref2 is set as a criterion (e.g., 0.5 degree) for determining whether the acceleration is instructed to the engine 30.

When the result in S118 is negative, i.e., it is determined that neither the acceleration nor the deceleration is instructed to the engine 30, in other words, it is immediately after the engine start or in the condition where the boat 1 cruises at constant speed, the program proceeds to S120, in which the first and second solenoid valves 86*a*, 86*b* (indicated by "1ST SOL," "2ND SOL" in the drawing) are both made ON to select the second speed in the transmission 46, and to S122, in which the bit of the acceleration determining flag is reset to 0.

On the other hand, when the result in S118 is affirmative, the program proceeds to S124, in which the first and second solenoid valves 86*a*, 86*b* are both made OFF to change the gear position (shift down the gear) of the transmission 46 from the second speed to the first speed. As a result, the output torque of the engine 30 is amplified through the transmission 46 (more precisely, the transmission mechanism 50) which has been shifted down to the first speed, and transmitted to the propeller 42 via the drive shaft 52*a* and propeller shaft 44, thereby improving the acceleration performance.

Then the program proceeds to S126, in which the bit of the acceleration determining flag is set to 1 and the present program is terminated. Specifically, the bit of the acceleration determining flag is set to 1 when the acceleration is determined to be instructed to the engine 30 and the transmission 46 is changed from the second speed to the first speed, and otherwise, reset to 0. Upon setting of the bit of the acceleration determining flag to 1, the result in S116 in the next and subsequent loops becomes negative and the program skips S118 and proceeds to S124 and S126.

Thus, the transmission 46 is set in the second speed during a period from when the engine 30 is started until the acceleration is started (i.e., during the normal operation), and is changed to the first speed when the acceleration is instructed and the change amount DTH becomes equal to or greater than the second predetermined value DTHref2. Since it is configured to keep the second speed during the normal operation, it becomes possible to ensure the usability of the outboard motor 10 similarly to that of an outboard motor having no transmission.

After the transmission 46 is changed to the first speed in S124, when the engine speed NE is gradually increased and the acceleration through the torque amplification in the first speed is completed (i.e., the acceleration range is saturated), the engine speed NE reaches the first predetermined speed NEref1. Subsequently, in the next program loop, the result in S114 becomes affirmative and the program proceeds to S128 onward. The first predetermined speed NEref1 is set to a relatively high value (e.g., 6000 rpm) as a criterion for determining whether the acceleration in the first speed is completed.

In S128, it is determined whether the engine speed NE is stable, i.e., the engine 30 is stably operated. This determination is made by comparing an absolute value of the change amount DNE of the engine speed NE calculated in S110 with a first prescribed value DNEref1. When the absolute value is less than the first prescribed value DNEref1, the engine speed NE is determined to be stable. The first prescribed value DNEref1 is set as a criterion (e.g., 500 rpm) for determining whether the engine speed NE is stable, i.e., the change amount DNE is relatively small.

When the result in S128 is negative, the program is terminated with the first speed being maintained, and when the result is affirmative, the program proceeds to S130, in which the first and second solenoid valves 86*a*, 86*b* are both made ON to change the transmission 46 (shift up the gear) from the first speed to the second speed. It causes the increase in the rotational speed of the drive shaft 52*a* and that of the propeller shaft 44, so that the boat speed reaches the maximum speed (in a range of the engine performance), thereby improving the speed performance.

After the step of S130, in S132, the bit of the second speed flag is set to 1 and in S134, the bit of the third speed flag is reset to 0.

Upon setting of the bit of the second speed flag to 1 in S132, the result in S112 in the next and subsequent loops becomes negative and the program proceeds to S136. Thus, when the bit of the second speed flag is set to 1, i.e., when the gear position is changed to the second speed after the acceleration in the first speed is completed, the process of S136 onward is conducted.

In S136, it is determined whether the switch 126 outputs the ON signal, i.e., whether the fuel consumption decreasing command for the engine 30 is inputted by the operator. When the result in S136 is affirmative, the program proceeds to S138, in which it is determined whether the engine speed NE is equal to or greater than a second predetermined speed NEref2. The second predetermined speed NEref2 is set to a value (e.g., 5000 rpm) slightly lower than the first predetermined speed NEref1, as a criterion for determining whether it is possible to change the gear position to the third speed (explained later).

When the result in S138 is affirmative, the program proceeds to S140, in which, similarly to S128, it is determined whether the engine speed NE is stable. Specifically, the absolute value of the change amount DNE of the engine speed NE is compared with a second prescribed value DNEref2. When the absolute value is less than the second prescribed value DNEref2, the engine speed NE is determined to be stable, and vice versa. The second prescribed value DNEref2 is set as a criterion (e.g., 500 rpm) for determining whether the change amount DNE is relatively small and the engine speed NE is stable.

When the result in S140 is negative or that in S136 or S138 is negative, the process of S130 to S134 is conducted, whereafter the program is terminated with the second speed being maintained. When the result in S140 is affirmative, the program proceeds to S142, in which the first solenoid valve 86*a* is made ON and the second solenoid valve 86*b* is made OFF to change the transmission 46 (shift up the gear) from the second speed to the third speed. As a result, the engine speed NE is decreased, thereby decreasing the fuel consumption, i.e., improving the fuel efficiency.

Next, the program proceeds to S144, in which the bit of the second speed flag is reset to 0, and to S146, in which the bit of the third speed flag is set to 1. Thus, the third speed flag is set to 1 when the gear position is changed from the second speed to the third speed after the acceleration is completed, and otherwise, reset to 0.

In the case where, before the bit of the third speed flag is set to 1 in S146, the result in S106 is affirmative, i.e., the deceleration is determined to be instructed to the engine 30, the program proceeds to S148, in which the first and second solenoid valves 86*a*, 86*b* are both made ON to change the transmission 46 (shift up the gear) to the second speed. Then the program proceeds to S150, S152 and S154, in which all bits of the second speed flag, third speed flag and acceleration determining flag are reset to 0, whereafter the program is terminated.

In a program loop after the bit of the third speed flag is set to 1, the result in S100 is negative and the process of S142 to S146 is conducted, whereafter the program is terminated with the third speed being maintained.

Returning to the explanation on the FIG. 5 flowchart, the program proceeds to S12, in which the operation for determining, in the case that the transmission 46 is in the third speed, whether a condition for decelerating or shifting down the gear to the second speed is met, is conducted.

Figure 7:
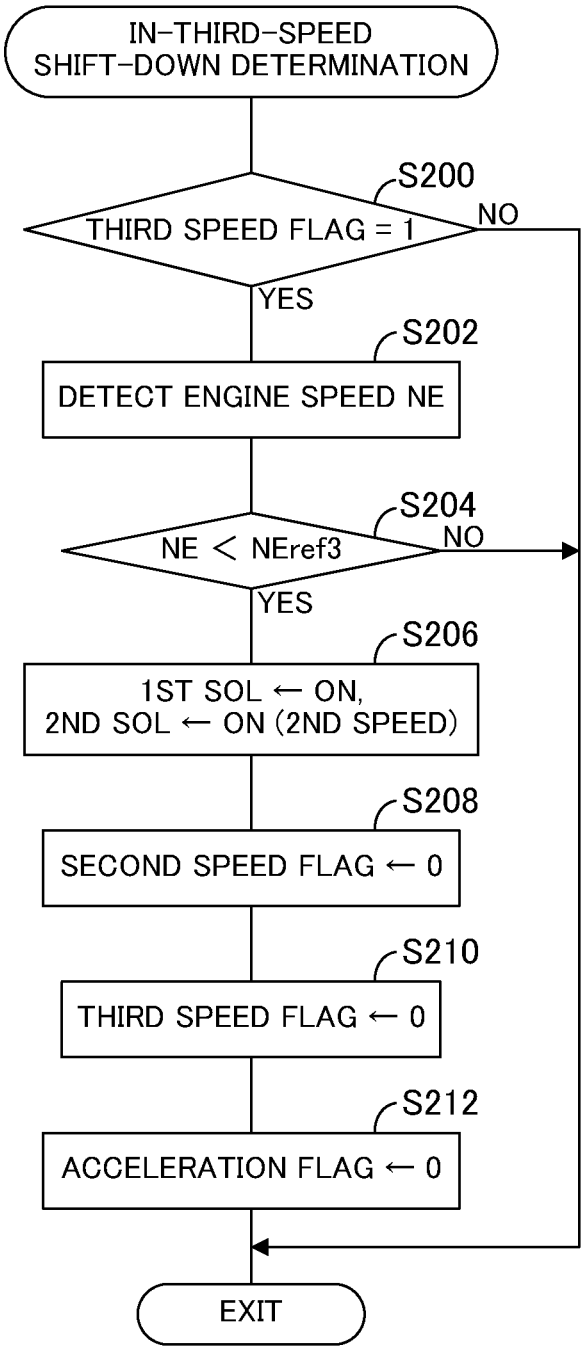
FIG. 7 is a subroutine flowchart showing the operation of in-third-speed shift-down determination of the FIG. 5 flowchart.

FIG. 7 is a subroutine flowchart showing the operation of in-third-speed deceleration (shifting down) determination. As shown in FIG. 7, in S200, it is determined whether the bit of the third speed flag is 1.

When the result in S200 is negative, the remaining steps are skipped, while, when the result is affirmative, the program proceeds to S202, in which the engine speed NE is detected.

Then the program proceeds to S204, in which the detected engine speed NE is decreased to a value below a third predetermined speed NEref3. The third predetermined speed NEref3 is set to a value (e.g., 3000 rpm) lower than the second predetermined speed NEref2, as a criterion for determining whether the gear position is to be changed from the third speed to the second speed (explained later).

When the result in S204 is negative, the remaining steps are skipped, while, when the result is affirmative, the program proceeds to S206, in which the first and second solenoid valves 86*a*, 86*b* are both made ON to change the transmission 46 (shift down the gear) from the third speed to the second speed. It is thus configured so that, in the case that the gear position is in the third speed, a fact that the engine speed NE is decreased to a value below the third predetermined speed NEref3 is employed as a condition for shifting down the gear to the second speed. With this, it becomes possible to prolong the cruising time in the third speed, which is selected to improve the fuel efficiency, to a maximum extent.

After the step of S206, the program proceeds to S208, S210 and S212, in which all bits of the second speed flag, third speed flag and acceleration determining flag are reset to 0, whereafter the program is terminated.

Figure 8:
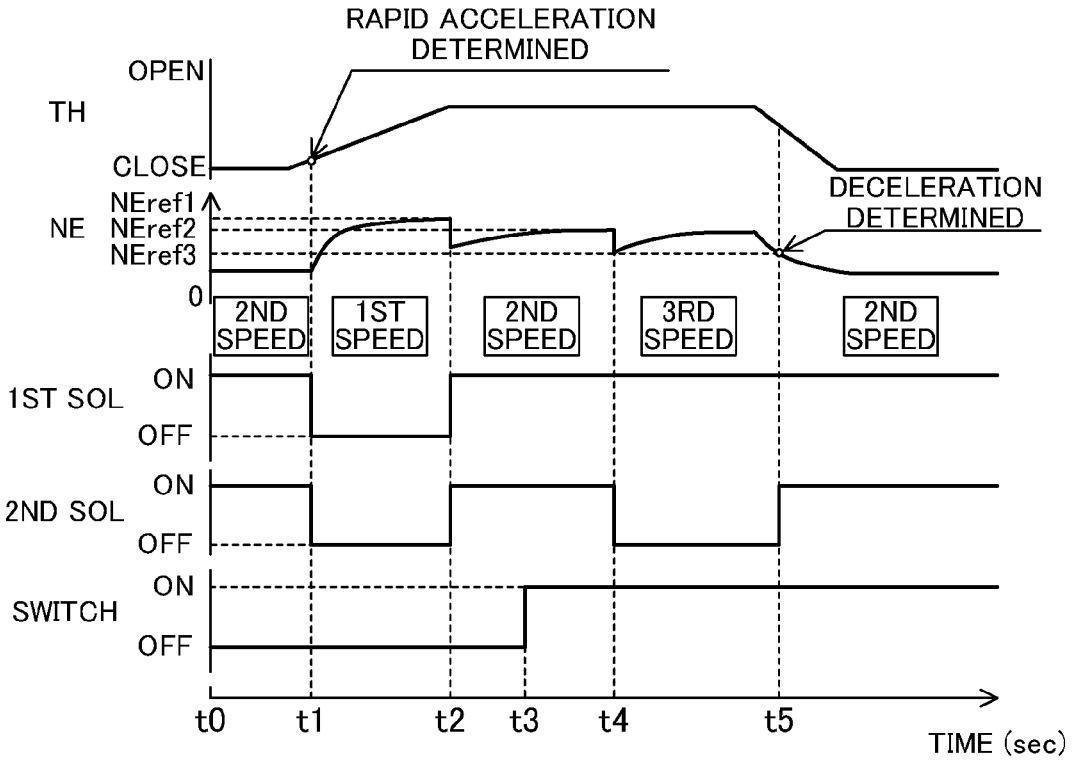
FIG. 8 is a time chart for explaining the operation of the flowcharts in FIGS. 5 to 7.

FIG. 8 is a time chart for explaining the operation of the foregoing flowcharts.

As shown in FIG. 8, in the normal operation from the time t0 to t1, the transmission 46 is set in the second speed (S120). Then, when the throttle valve 38 is opened upon the manipulation of the lever 122 by the operator and, at the time t1, it is determined that the acceleration is instructed to the engine 30 (S118), the gear position is changed from the second speed to the first speed (S124).

The engine speed NE is gradually increased and when, at the time t2, it is determined that the engine speed NE is equal to or greater than the first predetermined speed NEref1 (S114) and the change amount DNE is less than the first prescribed value DNEref1 (S128), the gear position is changed from the first speed to the second speed (S130).

When, at the time t3, the switch 126 is manipulated by the operator to input the fuel consumption decreasing command (S136) and also when, at the time t4, it is determined that the engine speed NE is equal to or greater than the second predetermined speed NEref2 (S138) and the change amount DNE is less than the second prescribed value DNEref2 (S140), the gear position is changed from the second speed to the third speed (S142).

Then, when the engine speed NE is gradually decreased upon, for example, the manipulation of the lever 122 by the operator to input a regulation command for decreasing the engine speed NE and, at the time t5, the engine speed NE becomes lower than the third predetermined speed NEref3 (S204), the gear position is changed from the third speed to the second speed (S206).

As mentioned in the foregoing, in the outboard motor control apparatus according to the first embodiment, there are equipped with an engine speed detector (crank angle sensor 102, ECU 110, S108, S202) that detects speed of the engine (NE), an acceleration instruction determiner (ECU 110, S118) that determines whether acceleration is instructed to the engine when the second speed is established and a transmission controller (ECU 110, S114, S118, S124, S128, S130) that controls operation of the transmission to change the gear position from the second speed to the first speed when the acceleration is determined to be instructed, and then change back the gear position from the first speed to the second speed based on the detected engine speed (NE), more specifically, an engine speed detector (crank angle sensor 102, ECU 110, S108, S202) that detects speed of the engine (NE), an engine speed change amount detector (ECU 110, S110) that detects a change amount of the engine speed (DNE), a throttle opening change amount detector (throttle opening sensor 96, ECU 110, S104) that detects a change amount of throttle opening (DTH) of the engine (30), an acceleration instruction determiner (ECU 110, S118) that determines whether acceleration is instructed to the engine when the second speed is established and a transmission controller (ECU 110, S114, S118, S124, S128, S130) that controls operation of the transmission to change the gear position from the second speed to the first speed when the detected change amount of the throttle opening (DTH) is equal to or greater than a predetermined value (DTHref2), and then change back the gear position from the first speed to the second speed when the detected engine speed (NE) is equal to or greater than a first predetermined speed (NEref1) and the detected change amount of the engine speed (DNE) is less than a first prescribed value (DNEref1).

With this, it becomes possible to amplify the torque to be transmitted to the propeller 42 to improve the acceleration performance, i.e., to select the optimal gear position in accordance with the operating condition of the engine 30. Further, since the engine speed NE is detected and based thereon, the gear position is changed (returned) from the first speed to the second speed, it becomes possible to change the gear position to the second speed immediately after the acceleration through the torque amplification in the first speed is completed and hence, the required time after the acceleration is completed until reaching the maximum boat speed can be shortened.

The apparatus further includes the switch 126 installed to be manipulated by an operator to input a fuel consumption decreasing instruction for decreasing fuel consumption of the engine 30, and the transmission controller controls the operation of the transmission to change the gear position from the second speed to third speed when the fuel consumption decreasing instruction is inputted through the switch 124 and also when the detected engine speed NE is equal to or greater than a second predetermined speed NEref2 and the detected change amount of the engine speed DNE is less than a second prescribed value DNEref2;.

With this, when the switch 126 is manipulated because the operator desires to travel the boat with high fuel efficiency, and also when the engine speed NE is relatively high and the engine 30 is stably operated (i.e., the change amount DNE thereof is relatively small), the gear position can be changed to the third speed (which is for the high speed cruising) to decrease the engine speed NE, thereby improving the fuel efficiency.

In the apparatus, the transmission controller controls the operation of the transmission to change the gear position from the third speed to the second speed when the detected engine speed NE is less than a value below a third predetermined speed NEref3 set lower than the second predetermined speed NEref2.

With this, it becomes possible to prolong the operating time in the third speed, which is selected to improve the fuel efficiency, to a maximum extent, thereby achieving the gear change control in line with the operator's intention to decrease the fuel consumption.

An outboard motor control apparatus according to a second embodiment of the invention will be explained.

FIG. 9 is a flowchart similar to FIG. 6, but showing transmission control operation and engine speed control operation by the ECU 110.

The program begins at S300, in which it is determined whether the shift position of the transmission 46 is neutral. This determination is made by checking as to whether the neutral switch 100 outputs the ON signal. When the result in S300 is negative, i.e., it is determined to be in gear, the program proceeds to S302 and S304, in which, similarly to in S102 and S104 in the FIG. 6 flowchart, the throttle opening TH and the change amount DTH are detected or calculated.

The program proceeds to S306, in which the same process in S106 of the FIG. 6 flowchart is conducted. When the result in S306 is negative, the program proceeds to S308, in which it is determined whether the bit of the third speed flag is 0. Since the initial value of this flag is 0, the result in S308 in the first program loop is generally affirmative and the program proceeds to S310.

The process of S310 to S324 is conducted similarly to S108 to S122 of the FIG. 6 flowchart. When the result in S320 is affirmative, the program proceeds to S326, in which a slip ratio S indicating the rotating condition of the propeller 42 is detected or calculated. The slip ratio S is calculated based on theoretical velocity Va and actual velocity V of the boat 1, using Equation (1) as follows:

$$\text{Slip ratio } S = (\text{Theoretical velocity } Va\ (\text{Km/h}) - \text{Actual velocity } V\ (\text{Km/h}))/\text{Theoretical velocity } Va\ (\text{Km/h}) \quad \text{Equation (1)}$$

In Equation (1), the actual velocity V is obtained based on the output of the boat speed sensor 130. The theoretical velocity Va is calculated based on the operating condition of the engine 30 and transmission 46 and specification of the propeller 42, as can be seen in Equation (2) as follows:

$$\text{Theoretical velocity } Va\ (\text{Km/h}) = (\text{Engine speed } NE\ (\text{rpm}) \times \text{Propeller pitch (inch)} \times 60 \times 2.54 \times 10^{-5})/(\text{Gear ratio of gear position}) \quad \text{Equation (2)}$$

In Equation (2), the propeller pitch is a value indicating a theoretical distance by which the boat 1 proceeds per one rotation of the propeller 42. The gear ratio of gear position is a gear ratio of the currently-selected gear position in the transmission 46, e.g., is 2.0 in the second speed, as mentioned above. The value of 60 is used for converting the engine speed NE for one minute into that for one hour, and the value of $2.54 \times 10^{-5}$ is used for converting a unit of the propeller pitch from inch to kilometer.

The program proceeds to S328, in which it is determined whether the slip ratio S of the propeller 42 is equal to or less than a second predetermined slip ratio (predetermined slip ratio) Sref2 set smaller than a first predetermined slip ratio Sref1 (explained later). The second predetermined slip ratio Sref2 is set as a criterion (e.g., 0.3) for determining that, when the slip ratio S is at or below this value, the propeller 42 is in the rotating condition where its grip force is relatively large.

When the result in S328 is negative, the program proceeds to S330, in which it is determined whether the slip ratio S is equal to or greater than the first predetermined slip ratio Sref1. The first predetermined slip ratio Sref1 is set as a criterion (e.g., 0.5) for determining that, when the slip ratio S is at or above this value, the propeller 42 is rotated idly because, for instance, it draws in air bubbles generated around the hull 12 immediately after the acceleration is started, and therefore in the rotating condition where its grip force is relatively small.

When the result in S330 is affirmative, the program proceeds to S332, in which the bit of an ignition timing retard flag (initial value 0; indicated by "retard flag" in the drawing) is set to 1. When the bit of this flag is set to 1, in another program which is not shown, retard control for retarding the ignition timing of the engine 30 is conducted, in other words, the ignition timing calculated based on the output of the crank angle sensor 102 (i.e., the engine speed NE), etc., is retarded by a predetermined angle (e.g., 5 degrees) to decrease the output of the engine 30.

When the bit of the ignition timing retard flag is reset to 0, the retard control is not conducted and normal ignition timing control is conducted. Thus, the process of S332 amounts to the operation for decreasing the engine output.

In response to the decrease in the engine output, the grip force of the propeller 42 is increased instantaneously and the slip ratio S is decreased to a value below the first predetermined slip ratio Sref1, so that the result in S330 in the next and subsequent loops becomes negative and the program proceeds to S334. In S334, the bit of the ignition timing retard flag is reset to 0 to stop the foregoing retard control and conduct the normal ignition timing control.

When the grip force of the propeller 42 is further increased and the slip ratio S is decreased to a value at or below the second predetermined slip ratio Sref2, the result in S328 is affirmative and the program proceeds to S336, in which the first and second solenoid valves 86*a*, 86*b* are both made OFF to change the transmission 46 (shift down the gear) from the second speed to the first speed.

As a result, the output torque of the engine 30 is amplified through the transmission 46 (precisely, the transmission mechanism 50) which has been shifted down to the first speed, and transmitted to the propeller 42 via the drive shaft 52*a* and propeller shaft 44, thereby improving the acceleration performance.

Then the program proceeds to S338, in which the desired engine speed NEa set in accordance with the position of the lever 122 is changed so as to achieve the maximum torque of the engine 30. Specifically, regardless of the lever position, the desired engine speed NEa is set with engine speed (hereinafter called the "maximum torque engine speed") NEtmax with which the engine torque becomes maximum.

Figure 10:
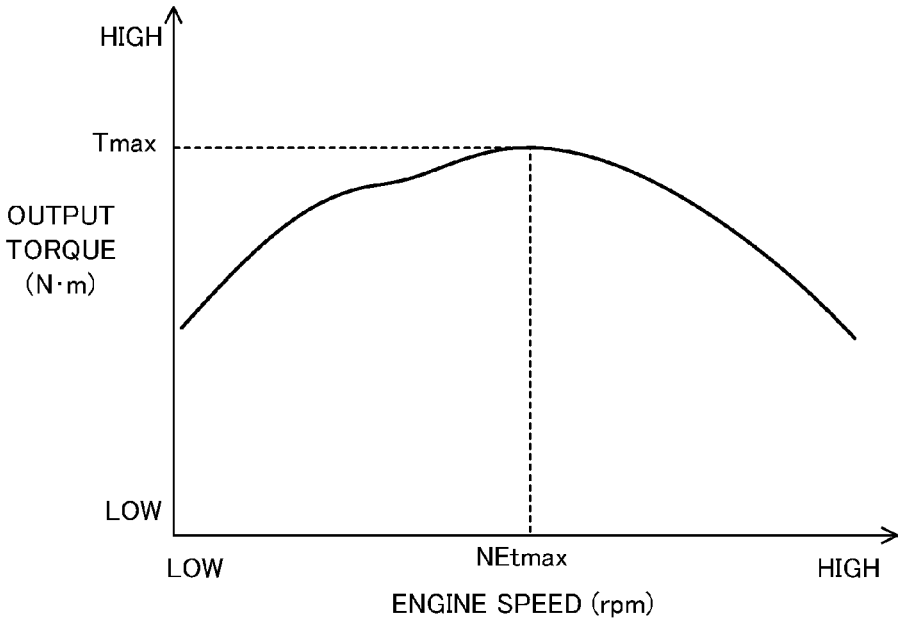
FIG. 10 is a view showing the characteristics of output torque relative to speed of an internal combustion engine of an outboard motor shown in FIG. 9.

FIG. 10 is a view (engine performance diagram) showing the characteristics of the output torque of the engine 30 with respect to the engine speed NE according to the second embodiment.

The maximum torque engine speed NEtmax will be explained with reference to FIG. 10. The output torque of the engine 30 is relatively low when the engine speed NE is low, is gradually increased with increasing engine speed NE, and becomes a maximum value (indicated by "Tmax" in the drawing) when the engine speed NE reaches a predetermined speed. This predetermined speed is the maximum torque engine speed NEtmax of the engine 30. When the engine speed NE exceeds the speed NEtmax and is further increased, the output torque is gradually decreased.

Thus, in S338, after the acceleration is determined to be instructed to the engine 30 so that the gear position is changed from the second speed to the first speed, the desired engine speed NEa is changed to achieve the maximum torque of the engine 30, i.e., is set with the maximum torque engine speed NEtmax. As a result, the operation of the engine 30 is controlled so as to achieve the maximum torque without revving abruptly.

Next, the program proceeds to S340, in which the bit of the acceleration determining flag is set to 1 and the present program is terminated. Upon setting of the bit of this flag to 1, the result in S318 in the next and subsequent loops becomes negative and the steps of S320, S326 and S328 are skipped. Then the process of S336 to S340 is conducted.

After that, when the engine speed NE is gradually increased and reaches the first predetermined speed NEref1, the result in S316 is affirmative and the program proceeds to S342. The process of S342 to S368 is conducted similarly to S128 to S154 of the FIG. 6 flowchart. In a program loop after the bit of the third speed flag is set to 1, the result in S308 is negative and the process of S356 to S360 is conducted, whereafter the program is terminated with the third speed being maintained.

As mentioned in the foregoing, the transmission 46 is configured to establish the second speed in the normal operation other than the rapid acceleration or fuel-efficient operation. Then, in the condition where the second speed is established, when the lever 122 is manipulated by the operator to change the shift position of the transmission 46 to neutral, the result in S300 is affirmative and the program proceeds to S370.

In S370, the first and second solenoid valves 86*a*, 86*b* are both made OFF to change the transmission 46 from the second speed to the first speed. Thus, since the gear position is changed to the first speed in which the second-speed and third-speed hydraulic clutches C2 and C3 are not supplied with hydraulic pressure from the pump 60, load on the pump 60 can be decreased and accordingly, friction of the engine 30 driving the pump 60 can be decreased, thereby decreasing the fuel consumption of the engine 30.

Figure 11:
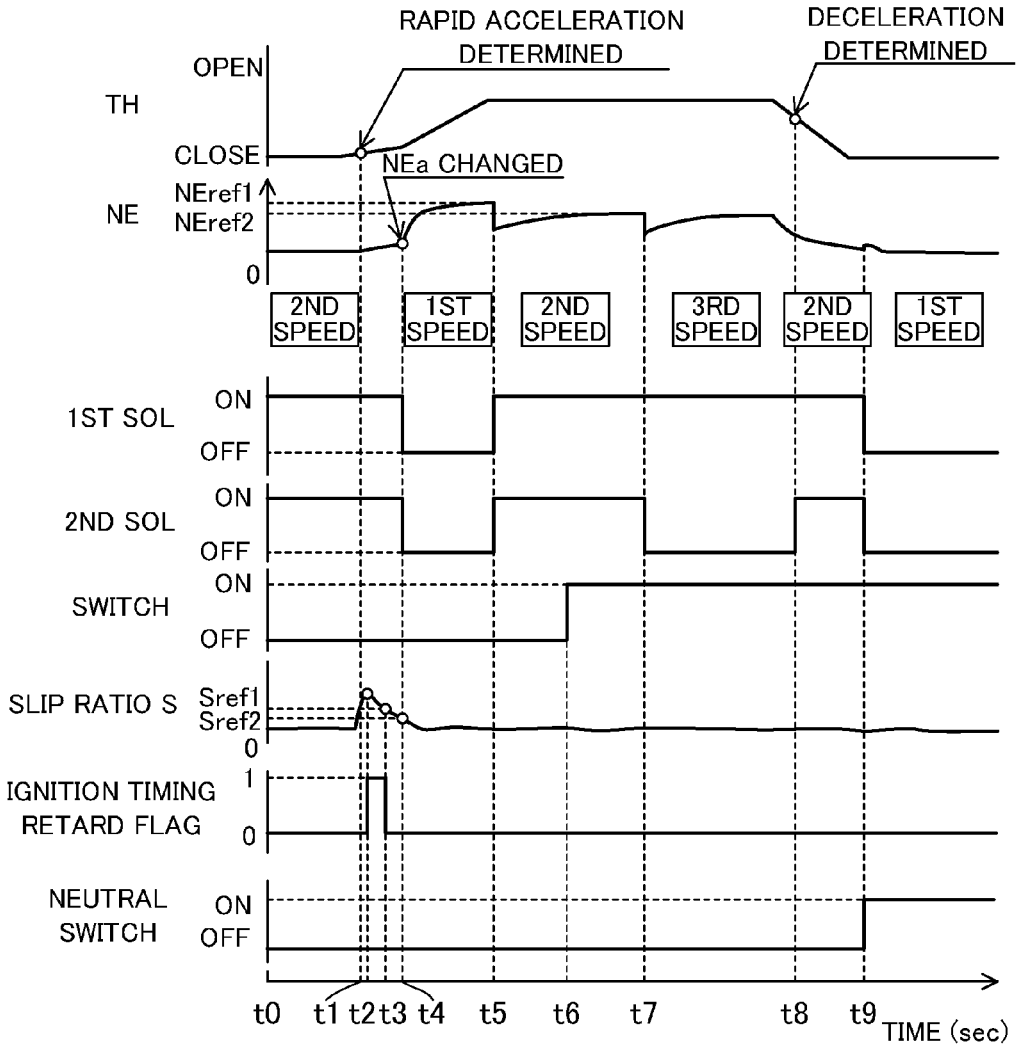
FIG. 11 is a time chart for explaining the operation of the FIG. 9 flowchart.

FIG. 11 is a time chart similar to FIG. 8, but explaining the above operation.

As shown in FIG. 11, in the normal operation from the time t0 to t1, the transmission 46 is set in the second speed (S322). Then, upon the manipulation of the lever 122 by the operator, the throttle valve 38 is opened and, at the time t1, the acceleration is determined to be instructed to the engine 30 (S320).

Immediately after the acceleration is started, the propeller 42 tends to be rotated idly because it draws in air bubbles generated around the hull 12, and therefore the grip force thereof becomes relatively small so that the slip ratio S rises. At the time t2, when the slip ratio S is determined to be equal to or greater than the first predetermined slip ratio Sref1 (S330), the bit of the ignition timing retard flag is set to 1 to decrease the engine output (S332).

The decrease in the engine output causes the increase in the grip force, i.e., the decrease in the slip ratio S. When, at the time t3, the slip ratio S is less than the first predetermined slip ratio Sref1, the bit of the ignition timing retard flag is reset to 0 to stop decreasing the engine output.

When, at the time t4, the slip ratio S is decreased to a value at or below the second predetermined slip ratio Sref2 (S328), the gear position is changed from the second speed to the first speed (S336), and the desired engine speed NEa is changed to achieve the maximum torque of the engine 30, i.e., is set with the maximum torque engine speed NEtmax (S338).

The engine speed NE is gradually increased and when, at the time t5, it is determined that the engine speed NE is equal to or greater than the first predetermined speed NEref1 (S316) and also that the change amount DNE is less than the first prescribed value DNEref1 (S342), the gear position is changed from the first speed to the second speed (S344).

The explanation on the times t6 and t7 is omitted here, as it is the same as that on the times t3 and t4 in FIG. 8.

After the time t7, when the throttle valve 38 is closed upon, for example, the operator's input of a regulation command for decreasing the engine speed NE and, at the time t8, the deceleration is determined to be instructed (S306), the gear position is changed from the third speed to the second speed (S362).

At the time t9, when the shift position of the transmission 46 is determined to be neutral, i.e., the neutral switch 100 outputs the ON signal (S300), the gear position is changed from the second speed to the first speed (S370).

The remaining configuration as well as the effects is the same as that in the first embodiment.

As stated above, the first and second embodiments are configured to have an apparatus and a method for controlling operation of an outboard motor (10) adapted to be mounted on a stern of a boat (hull 12) and having an internal combustion engine (30) to power a propeller (42) through a propeller shaft (44), and a transmission (46) installed at a location between the engine and the propeller shaft, the transmission being selectively changeable in gear position to establish speeds including at least a first speed and a second speed and transmitting power of the engine to the propeller with a gear ratio determined by established speed, comprising: an engine speed detector (crank angle sensor 102, ECU 110, S108, S202, S310) that detects speed of the engine (NE); an acceleration instruction determiner (ECU 110, S118, S320) that determines whether acceleration is instructed to the engine when the second speed is established; and a transmission controller (ECU 110, S114, S118, S124, S128, S130, S316, S320, S336, S342, S344) that controls operation of the transmission to change the gear position from the second speed to the first speed when the acceleration is determined to be instructed, and then change back the gear position from the first speed to the second speed based on the detected engine speed (NE).

With this, since the gear position is changed from the second speed to the first speed when the acceleration is instructed to the engine 30, it becomes possible to amplify the torque to be transmitted to the propeller 42 to improve the acceleration performance, i.e., to select the optimal gear position in accordance with the operating condition of the engine 30. Further, since the engine speed NE is detected and based thereon, the gear position is changed (returned) from the first speed to the second speed, it becomes possible to change the gear position to the second speed immediately after the acceleration through the torque amplification in the first speed is completed and hence, the required time after the acceleration is completed until reaching the maximum boat speed can be shortened.

The apparatus and method further includes: an engine speed change amount detector (ECU 110, S110, S312) that detects a change amount of the engine speed (DNE); and the transmission controller controls the operation of the transmission to change the gear position from the first speed to the second speed based on the engine speed (NE) and the calculated change amount of the engine speed (DNE; S114, S128, S130, S316, S342, S344).

Since the gear position is changed from the first speed to the second speed based on the engine speed NE and the change amount DNE thereof, in addition to the above effects, it becomes possible to reliably change the gear position to the second speed immediately after the acceleration through the torque amplification in the first speed is completed.

In the apparatus and method, the acceleration instruction determiner includes: a throttle opening change amount detector (throttle opening sensor 96, ECU 110, S104, S304) that detects a change amount of throttle opening (DTH) of the engine; and determines that the acceleration is instructed when the detected change amount of the throttle opening (DTH) is equal to or greater than a predetermined value (DTHref2; S118, S320).

Since, it is configured to detect that the acceleration is instructed to the engine based on the change amount DTH of the throttle opening TH, in addition to the above effects, it becomes possible to accurately determine whether the acceleration is instructed.

In the apparatus and method, the transmission controller controls the operation of the transmission to change the gear position from the first speed to the second speed when the detected engine speed (NE) is equal to or greater than a first predetermined speed (NEref1) and the detected change amount of the engine speed (DNE) is less than a first prescribed value (DNEref1; S114, S128, S130, S316, S342, S344).

With this, in addition to the above effects, it becomes possible to reliably change the gear position to the second speed when the acceleration through the torque amplification in the first speed is completed, and hence, the required time after the acceleration is completed until reaching the maximum boat speed can be further shortened.

In the apparatus and method, the first predetermined speed (NEref1) is set to be a value which enables to indicate that the acceleration by the first speed has been saturated (S114, S316).

With this, in addition to the above effects, it becomes possible to reliably change the gear position to the second speed appropriately when the acceleration is completed.

In the apparatus and method, the first prescribed value (DNEref1) is set to be a value that enables to define a permissible change range of the engine speed (NE; S128, S342).

With this, in addition to the above effects, it becomes possible to change the gear position to the second speed at the appropriate time in accordance with the operating condition of the engine 30.

The apparatus and method further includes: a switch (126) installed to be manipulated by an operator to input a fuel consumption decreasing instruction for decreasing fuel consumption of the engine (30); and the transmission controller controls the operation of the transmission to change the gear position from the second speed to third speed when the fuel consumption decreasing instruction is inputted through the switch (124) and also when the detected engine speed (NE) is equal to or greater than a second predetermined speed (NEref2) and the detected change amount of the engine speed (DNE) is less than a second prescribed value (DNEref2) when the second speed is established (S136-S142, S350-S356).

With this, when the switch 126 is manipulated because the operator desires to travel the boat with high fuel efficiency, and also when the engine speed NE is relatively high and the engine 30 is stably operated (i.e., the change amount DNE thereof is relatively small), the gear position can be changed to the third speed (which is for the high speed cruising) to decrease the engine speed NE, thereby improving the fuel efficiency.

In the apparatus and method, the second prescribed value (DNEref2) is set to be a value that enables to define a permissible change range of the engine speed (NE; S140, S354).

With this, in addition to the above effects, it becomes possible to change the gear position to the third speed at the appropriate time in accordance with the operating condition of the engine 30.

In the first embodiment, in the apparatus and method, the transmission controller controls the operation of the transmission to change the gear position from the third speed to the second speed when the third speed is established and the detected engine speed (NE) is less than a value below a third predetermined speed (NEref3) set lower than the second predetermined speed (NEref2; S200-S206).

With this, it becomes possible to prolong the operating time in the third speed, which is selected to improve the fuel efficiency, to a maximum extent, thereby achieving the gear change control in line with the operator's intention to decrease the fuel consumption.

The second embodiment is configured to have an apparatus and method further including: a neutral position determiner (neutral switch 100, ECU 110, S300) that determines whether the transmission is in a neutral position; and the transmission controller controls the operation of the transmission to change the gear position from the second speed to the first speed when the second speed is established and the transmission is determined to be in the neutral position (S300, S370).

Specifically, the transmission 46 is configured to establish the second speed in the normal operation, and establish the first speed when the transmission clutch (C2) is not supplied with the hydraulic pressure from the pump 60, while establishing the second speed when it is supplied. With this, it becomes possible to limit the operation of the pump 60, thereby decreasing the fuel consumption of the engine 30. In other words, when the transmission 46 is in the neutral position, the gear position is changed from the second speed to the first speed (in which the hydraulic pressure is not supplied to the transmission clutch (C2) from the pump 60), thereby achieving the above effects.

The apparatus and method further include: a hydraulic clutch (C2) that is installed in the transmission and adapted to establish the speeds including the first speed and the second speed; and the transmission controller controls the operation of the transmission to establish the first speed when the clutch is not supplied with hydraulic pressure.

With this, the above effects can be achieved more reliably.

The apparatus and method further include: an actuator (throttle motor 40) that is adapted to open and close a throttle valve (38) of the engine (30); an actuator controller (ECU 110) that controls operation of the actuator (40) such that the engine speed (NE) converges to a desired engine speed (NEa); and a desired engine speed changer (ECU 110, S338) that changes the desired engine speed (NEa) such that output torque of the engine (30) becomes maximum when the gear position is changed from the second speed to the first speed.

Since the engine operation when changing the gear position at the acceleration can be controlled appropriately, it becomes possible to prevent the engine from revving and improve the acceleration performance of immediately after the acceleration is started. Specifically, when the acceleration is determined to be instructed to the engine 30, since the gear position is changed from the second speed to the first speed, the torque to be transmitted to the propeller 42 can be amplified.

Also, after thus changing the gear position, the desired engine speed NEa is changed so as to achieve the maximum torque of the engine 30, i.e., is set with the maximum torque engine speed NEtmax. As a result, the engine operation that achieves the maximum torque can be maintained without revving abruptly, thereby improving the acceleration performance as mentioned.

In the apparatus and method, the transmission controller includes: a slip ratio detector (110, 130, S328) that detects a slip ratio (S) of the propeller (42) based on theoretical boat velocity (Va) and actual boat velocity (V); and controls the operation of the transmission to change the gear position from the second speed to the first speed when the acceleration is determined to be instructed and the detected slip ratio (S) is equal to or less than a predetermined slip ratio (Sref2; S328, S336).

With this, in addition to the above effects, it becomes possible to change the gear position from the second speed to the first speed at the appropriate time when the grip force of the propeller 42 is increased after the acceleration. As a result, the output torque of the engine 30 is amplified through the transmission 46 and transmitted to the propeller 42, so that the boat speed immediately starts increasing, thereby improving the acceleration performance of immediately after the acceleration is started.

It should be noted that, although the ignition timing is retarded to decrease the engine output, it may instead be configured to decrease the fuel injection amount, or the ignition cut-off or fuel cut-off can be utilized for that purpose.

It should also be noted that the actual velocity V of the boat 1 can be detected by, in place of the boat speed sensor 130, a GPS (Global Positioning System) for instance.

It should also be noted that, although the first and second predetermined values DTHref1, DTHref2, first to third predetermined speeds NEref1, NEref2, NEref3, first and second prescribed values DNEref1, DNEref2, first and second predetermined slip ratios Sref1, Sref2, displacement of the engine 30 and other values are indicated with specific values in the foregoing, they are only examples and not limited thereto.

Japanese Patent Application Nos. 2009-285800, 2009-285801 and 2009-285806, all filed on Dec. 16, 2009 are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor for a boat and having an internal combustion engine to power a propeller through a propeller shaft, and a transmission installed at a location between the engine and the propeller shaft, the transmission being selectively changeable in gear position to establish speeds including at least a first speed, a second speed and a third speed, and transmitting power of the engine to the propeller with a gear ratio determined by established gear position, comprising:

an engine speed detector that detects speed of the engine;

an acceleration instruction determiner that determines whether acceleration is instructed to the engine when second gear is established;

a transmission controller that controls operation of the transmission to change the gear position from the second gear to the first gear when the acceleration is determined to be instructed, and then change back the gear position from the first to the second gear based on the detected engine speed;

a hydraulic clutch that is installed in the transmission and adapted to establish a first gear and a second gear;

wherein the transmission controller controls the operation of the transmission to establish first gear when the clutch is not supplied with hydraulic pressure; and a switch installed to be manipulated by an operator to input a fuel consumption decreasing instruction for decreasing fuel consumption of the engine;

wherein the transmission controller controls the operation of the transmission to change the gear position from second gear to third gear when the fuel consumption decreasing instruction is inputted through the switch and also when the detected engine speed is equal to or greater than a second predetermined speed and the detected change amount of the engine speed is less than a second prescribed value when the second speed is established.

2. The apparatus according to claim 1, further including:

an engine speed change amount detector that detects a change amount of the engine speed;

and wherein the transmission controller controls the operation of the transmission to change the gear position from the first gear to the second gear based on the engine speed and the calculated change amount of the engine speed.

3. The apparatus according to claim 1, wherein the acceleration instruction determiner includes:

a throttle opening change amount detector that detects a change amount of throttle opening of the engine;

and determines that the acceleration is instructed when the detected change amount of the throttle opening is equal to or greater than a predetermined value.

4. The apparatus according to claim 2, wherein the transmission controller controls the operation of the transmission to change the gear position from the first gear to the second gear when the detected engine speed is equal to or greater than a first predetermined speed and the detected change amount of the engine speed is less than a first prescribed value.

5. The apparatus according to claim 4, wherein the first predetermined speed is set to a value which indicates that the acceleration by the first speed has been completed.

6. The apparatus according to claim 4, wherein the first prescribed value is set to a value that defines a permissible change range of the engine speed.

7. The apparatus according to claim 1, wherein the second prescribed value is set to be a value that defines a permissible change range of the engine speed.

8. The apparatus according to claim 1, wherein the transmission controller controls the operation of the transmission to change the gear position from the third gear to the second gear when the third gear is established and the detected engine speed is less than a value below a third predetermined speed set lower than the second predetermined speed.

9. The apparatus according to claim 1, further comprising:

a neutral position determiner that determines whether the transmission is in a neutral position;

and the transmission controller controls the operation of the transmission to change the gear position from the second gear to the first speed when the second gear is established and the transmission is determined to be in the neutral position.

10. The apparatus according to claim 1, further including:

an actuator that is adapted to open and close a throttle valve of the engine;

an actuator controller that controls operation of the actuator such that the engine speed converges to a desired engine speed; and a desired engine speed changer that changes the desired engine speed such that output torque of the engine becomes maximum when the gear position is changed from the second gear to the first gear.

11. The apparatus according to claim 1, wherein the transmission controller includes:

a slip ratio detector that detects a slip ratio of the propeller based on theoretical boat velocity and actual boat velocity;

and controls the operation of the transmission to change the gear position from the second gear to the first gear when the acceleration is determined to be instructed and the detected slip ratio is equal to or less than a predetermined slip ratio.

12. A method for controlling operation of an outboard motor for a boat and having an internal combustion engine to power a propeller through a propeller shaft, and a transmission installed at a location between the engine and the propeller shaft, the transmission being selectively changeable in gear position to establish speeds including at least a first gear, a second gear, and a third gear, and transmitting power of the engine to the propeller with a gear ratio determined by established gear position, comprising the steps of:

detecting speed of the engine;

determining whether acceleration is instructed to the engine when the second gear is established; and controlling operation of the transmission to change the gear position from the second gear to the first gear when the acceleration is determined to be instructed, and then change back the gear position from the first gear to the second gear based on the detected engine speed, wherein the step of transmission controlling controls the operation of the transmission to establish the first gear, when a hydraulic clutch that is installed in the transmission is in second gear, and the clutch is not supplied with hydraulic pressure and inputting a fuel consumption decreasing command for decreasing fuel consumption of the engine through a switch that is manipulated by an operator to input a fuel consumption decreasing instruction, wherein the step of transmission controlling controls the operation of the transmission to change the gear position from a second speed to a third speed when the fuel consumption decreasing instruction is inputted, and also when the detected engine speed is equal to or greater than a second predetermined speed and the detected change amount of the engine speed is less than a second prescribed value when the second speed is established.

13. The method according to claim 12, further including the step of:

detecting a change amount of the engine speed;

and the step of transmission controlling controls the operation of the transmission to change the gear position from the first gear to the second gear based on the engine speed and the detected change amount of the engine speed.

14. The method according to claim 12, wherein the step of acceleration instruction determining includes the step of:

detecting a change amount of throttle opening of the engine;

and determines that the acceleration is instructed when the detected change amount of the throttle opening is equal to or greater than a predetermined value.

15. The method according to claim 13, wherein the step of transmission controlling controls the operation of the transmission to change the gear position from the first to the second gear when the detected engine speed is equal to or greater than a first predetermined speed and the detected change amount of the engine speed is less than a first prescribed value.

16. The method according to claim 15, wherein the first predetermined speed is set to be a value which indicates that the acceleration by the first speed has been saturated.

17. The method according to claim 15, wherein the first prescribed value is set to be a value that defines a permissible change range of the engine speed.

18. The method according to claim 12, wherein the second prescribed value is set to be a value that defines a permissible change range of the engine speed.

19. The method according to claim 12, wherein the step of transmission controlling controls the operation of the transmission to change the gear position from the third speed to the second speed when the third speed is established and the detected engine speed is less than a value below a third predetermined speed set lower than the second predetermined speed.

20. The method according to claim 12, further including the steps of:

controlling operation of an actuator that is adapted to open and close a throttle valve of the engine such that the engine speed converges to a desired engine speed; and changing the desired engine speed such that output torque of the engine becomes maximum when the gear position is changed from the second gear to the first gear.

21. The method according to claim 12, wherein the step of transmission controlling includes the step of:

detecting a slip ratio of the propeller based on theoretical boat velocity and actual boat velocity;

and controls the operation of the transmission to change the gear position from the second gear to the first when the acceleration is determined to be instructed and the detected slip ratio is equal to or less than a predetermined slip ratio.

* * * * *